US005890686A

United States Patent [19]

Morales

[11] Patent Number: 5,890,686

[45] Date of Patent: Apr. 6, 1999

[54] BOTTLE SWING

[76] Inventor: Jesus Morales, P.O. Box 8791, Pittsburg, Calif. 94565

[21] Appl. No.: 906,121

[22] Filed: Jul. 25, 1997

[51] Int. Cl.[6] ..... A47F 5/12

[52] U.S. Cl. ..... 248/141; 215/395; 248/130; 248/311.3

[58] Field of Search ..... 248/130, 133, 248/137, 141, 311.3; 211/81; 215/395

[56] References Cited

U.S. PATENT DOCUMENTS

| | | | |
|---|---|---|---|
| 498,891 | 6/1893 | Knocker et al. | 248/141 |
| 711,339 | 10/1902 | Park | 248/141 |
| 1,400,025 | 12/1921 | Carey | 248/141 |
| 1,538,693 | 5/1925 | Gilbert | 248/141 |
| 1,742,041 | 12/1929 | Mangold | 248/141 |
| 2,467,866 | 4/1949 | Smolderen et al. | 211/81 X |
| 2,470,154 | 5/1949 | Fitgerald | 248/141 |
| 2,554,875 | 5/1951 | Okunami | 248/141 |
| 4,317,551 | 3/1982 | Bishop | 248/181 |
| 5,316,248 | 5/1994 | Allen | 248/137 X |

*Primary Examiner*—Derek J. Berger

[57] ABSTRACT

A water bottle swing is provided including a stand with a swing assembly rotatably coupled thereto. In use, a water bottle is situated within the swing assembly so the water may be easily dispensed therefrom. Further provided is a rigid retainer including a loop wire having a linear portion with a first end coupled to the swing assembly. The loop wire further has a second end with a circular loop portion formed thereon.

6 Claims, 2 Drawing Sheets

BOTTLE SWING

BACKGROUND OF THE INVENTION

1. Field of the Invention

The present invention relates to water dispensers and more particularly pertains to a new BOTTLE SWING for retaining a water bottle within the bottle swing when dispensing water therefrom.

2. Description of the Prior Art

The use of water dispensers is known in the prior art. More specifically, water dispensers heretofore devised and utilized are known to consist basically of familiar, expected and obvious structural configurations, notwithstanding the myriad of designs encompassed by the crowded prior art which have been developed for the fulfillment of countless objectives and requirements.

Known prior art water dispensers include U.S. Pat. No. 5,444,992; U.S. Pat. No. 5,439,142; U.S. Pat. No. Des. 350,483; U.S. Pat. No. 4,217,013; U.S. Pat. No. 4,721,276; and U.S. Pat. No. 5,127,618.

In these respects, the BOTTLE SWING according to the present invention substantially departs from the conventional concepts and designs of the prior art, and in so doing provides an apparatus primarily developed for the purpose of retaining a water bottle within a bottle swing when dispensing water therefrom.

SUMMARY OF THE INVENTION

In view of the foregoing disadvantages inherent in the known types of water dispensers now present in the prior art, the present invention provides a new BOTTLE SWING construction wherein the same can be utilized for retaining a water bottle within a bottle swing when dispensing water therefrom.

The general purpose of the present invention, which will be described subsequently in greater detail, is to provide a new BOTTLE SWING apparatus and method which has many of the advantages of the water dispensers mentioned heretofore and many novel features that result in a new BOTTLE SWING which is not anticipated, rendered obvious, suggested, or even implied by any of the prior art water dispensers, either alone or in any combination thereof.

To attain this, the present invention generally comprises a stand is provided including two pairs of legs. The legs of each pair have a first end coupled together thereby defining an inverted V-shaped configuration. It should be noted that the pairs of legs each reside in spaced vertical planes. For support purposes, the stand further includes a support assembly. As best shown in FIGS. 1 & 2, the support assembly includes four linear braces coupled to form a square. Corners of the square are mounted to each of the legs adjacent second ends thereof at a common elevation. As such, the support assembly serves to maintain the relative position of the pairs of legs. Next provided is a swing assembly including an O-ring ring and a pair of U-shaped members. Each of such U-shaped members has a pair of top ends coupled to the O-ring so that a remaining portion thereof resides therebelow. The top ends of the U-shaped members are coupled to the O-ring in order that a pair of planes in which the U-shaped members reside are perpendicular with respect to each other. One of the U-shaped members is rotatably coupled at a central extent thereof between the first ends of the legs of the stand such that the swing pivots only about a horizontal axis. Such coupling is preferably afforded by way of pair of pins which extend from the associated U-shaped member. These pins preferably engage corresponding apertures formed in the first ends of the legs. By this structure, the water bottle is situated within the swing assembly so that water may be easily dispensed therefrom. For maintaining the water bottle in place during use, a retainer is provided. Such retainer includes a tab which extends upwardly and radially outwardly from the top end of one of the U-shaped members. Note FIGS. 1 & 3. The tab has an aperture formed in an upper extent thereof. The retainer further includes a loop wire having a linear portion with a first end having a plurality of threaded grooves formed therein. A second end of the loop wire is equipped with a circular loop portion formed thereon. The loop portion resides in a plane that forms an obtuse angle with a plane in which the linear portion resides. During operation, the linear portion of the loop wire is adapted be slidably situated through the aperture of the tab so that the loop portion resides in a plane elevated from and parallel with that in which the O-ring of the swing assembly resides. In such orientation, the O-ring may be further situated about the spout of the water bottle. The retainer further includes a wing nut for screwably coupling with the threaded grooves of the linear portion of the wire loop. Such coupling precludes the removal of the wire loop from the tab which, in turn, precludes the removal of the water bottle from the swing assembly during use.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new BOTTLE SWING apparatus and method which has many of the advantages of the water dispensers mentioned heretofore and many novel features that result in a new BOTTLE SWING which is not anticipated, rendered obvious, suggested, or even implied by any of the prior art water dispensers, either alone or in any combination thereof.

It is another object of the present invention to provide a new BOTTLE SWING which may be easily and efficiently manufactured and marketed.

It is a further object of the present invention to provide a new BOTTLE SWING which is of a durable and reliable construction.

An even further object of the present invention is to provide a new BOTTLE SWING which is susceptible of a low cost of manufacture with regard to both materials and labor, and which accordingly is then susceptible of low prices of sale to the consuming public, thereby making such BOTTLE SWING economically available to the buying public.

Still yet another object of the present invention is to provide a new BOTTLE SWING which provides in the apparatuses and methods of the prior art some of the advantages thereof, while simultaneously overcoming some of the disadvantages normally associated therewith.

Still another object of the present invention is to provide a new BOTTLE SWING for retaining a water bottle within the bottle swing when dispensing water therefrom.

Even still another object of the present invention is to provide a new BOTTLE SWING that includes a stand with a swing assembly rotatably coupled thereto. In use, a water bottle is situated within the swing assembly so the water may be easily dispensed therefrom. Further provided is a rigid retainer including a loop wire having a linear portion with a first end coupled to the swing assembly. The loop wire further has a second end with a circular loop portion formed thereon.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
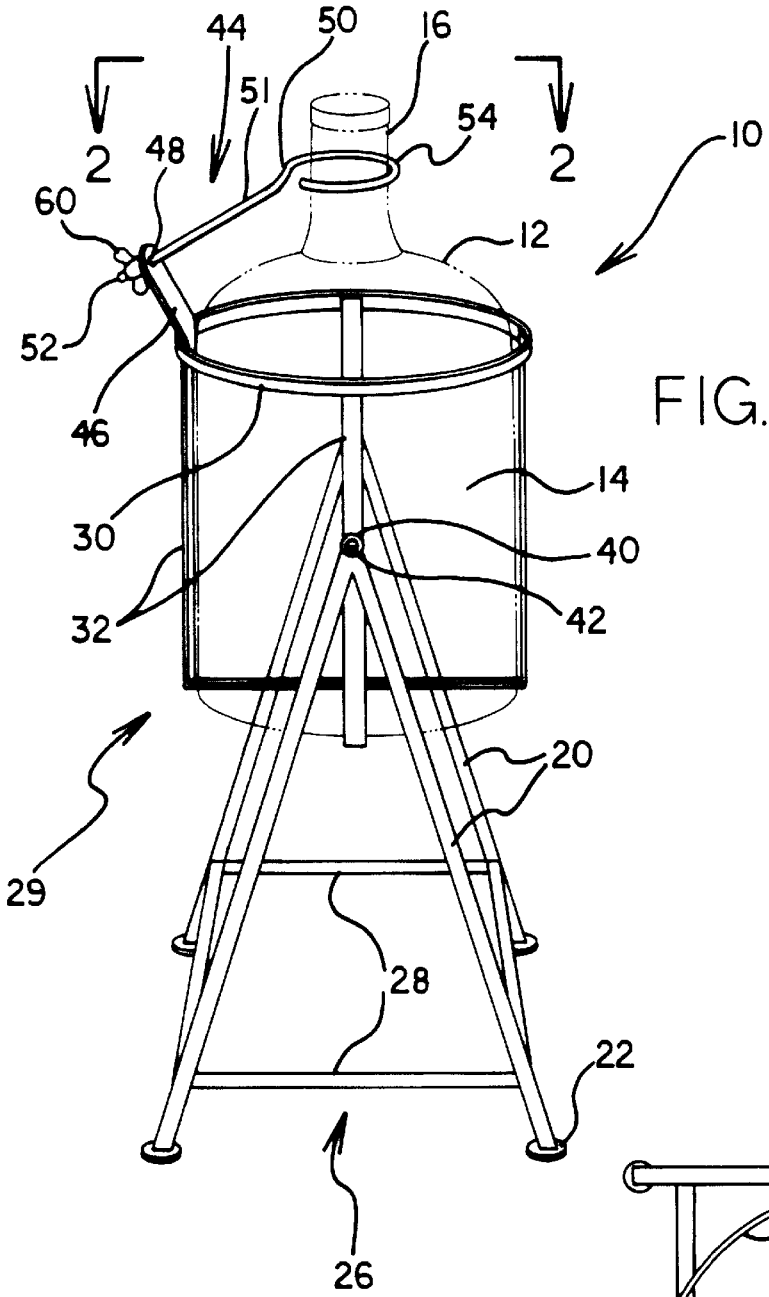
FIG. 1 is a perspective view of a new BOTTLE SWING according to the present invention.

With reference now to the drawings, and in particular to FIGS. 1 through 4 thereof, a new BOTTLE SWING embodying the principles and concepts of the present invention and generally designated by the reference numeral 10 will be described.

The present invention is adapted for use with a water bottle 12 having a body 14 with cylindrical configuration and a spout 16 formed on a top thereof. The spout has a tubular configuration with a diameter less than that of the body, as is conventional of large water bottles.

As shown in FIG. 1, a stand is provided including two pairs of legs 20. The legs of each pair have a first end coupled together thereby defining an inverted V-shaped configuration. It should be noted that the pairs of legs each reside in spaced vertical planes. In the preferred embodiment, second ends of each of the legs are equipped with a disk-shaped elastomeric pad 22.

Figure 2:
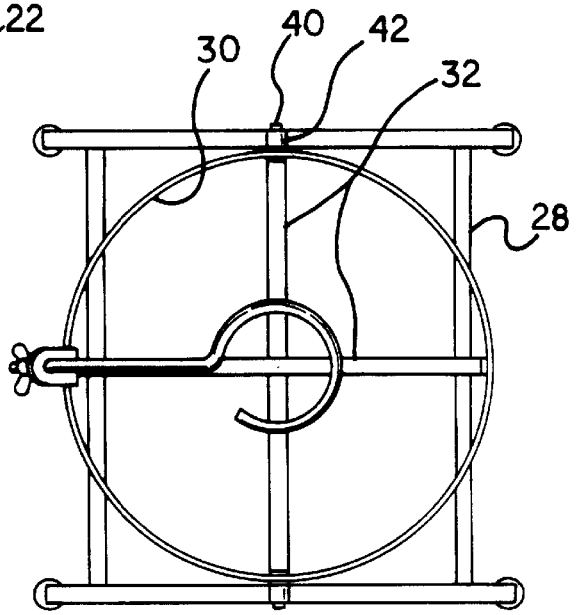
FIG. 2 is a top view of the present invention.
Figure 3:
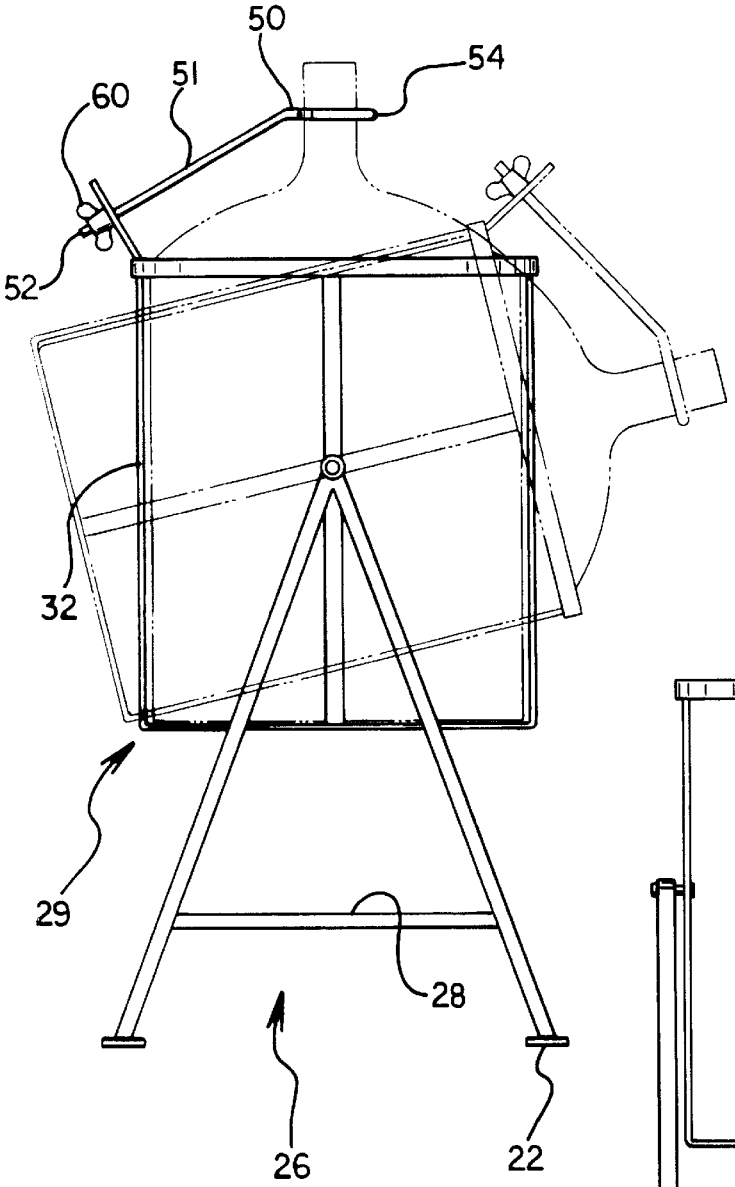
FIG. 3 is a side view of the present invention during use.
Figure 4:
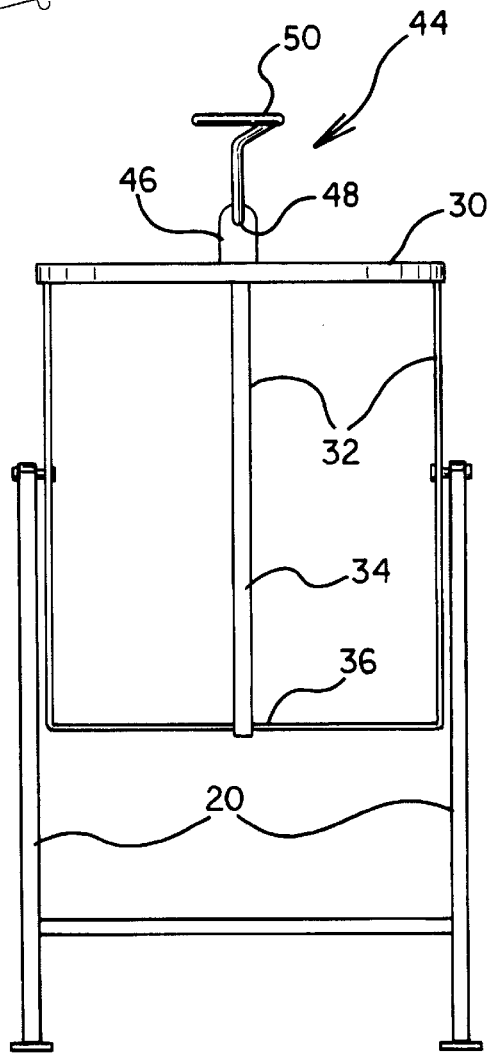
FIG. 4 is a side view of the present invention with the bottle removed.

For support purposes, the stand further includes a support assembly 26. As best shown in FIGS. 1 & 2, the support assembly includes four linear braces 28 coupled to form a square. Corners of the square are mounted to each of the legs adjacent second ends thereof at a common elevation. As such, the support assembly serves to maintain the relative position of the pairs of legs.

Next provided is a swing assembly 29 including an O-ring 30 and a pair of U-shaped members 32. Each of such U-shaped members has a pair of top ends coupled to the O-ring so that a remaining portion thereof resides therebelow. The top ends of the U-shaped members are coupled to the O-ring in order that a pair of planes in which the U-shaped members reside are perpendicular with respect to each other. It should be noted that each U-shaped member comprises a pair of linear strips 34 which are coupled together in parallel relationship via a linear coupling strip 36. The parallel strips define right angles with the coupling strip.

One of the U-shaped members is rotatably coupled at a central extent thereof between the first ends of the legs of the stand such that the swing pivots only about a horizontal axis. Such coupling is preferably afforded by way of pair of pins 40 which extend from the associated U-shaped member. These pins preferably engage corresponding apertures 42 formed in the first ends of the legs. By this structure, the water bottle is situated within the swing assembly so that water may be easily dispensed therefrom.

For maintaining the water bottle in place during use, a retainer 44 is provided. Such retainer includes a tab 46 which extends upwardly and radially outwardly from the top end of one of the U-shaped members. Note FIGS. 1 & 3. The U-shaped member to which the tab is coupled is ideally not the U-shaped member which is rotatably coupled to the stand. The tab has an aperture 48 formed in an upper extent thereof. The retainer further includes a rigid metal loop wire 50 having a linear portion 51 with a first end having a plurality of threaded grooves 52 formed therein. A second end of the loop wire is equipped with a circular loop portion 54 formed thereon. The loop portion resides in a plane that forms an obtuse angle with a plane in which the linear portion resides. During operation, the linear portion of the loop wire is adapted be slidably situated through the aperture of the tab so that the loop portion resides in a plane elevated from and parallel with that in which the O-ring of the swing assembly resides. In such orientation, the O-ring may be further situated about the spout of the water bottle.

The retainer further includes a wing nut 60 for screwably coupling with the threaded grooves of the linear portion of the wire loop. Such coupling precludes the removal of the wire loop from the tab which, in turn, precludes the removal of the water bottle from the swing assembly during use.

In an alternate embodiment, a pair of stands may be situated in a vertical orientation for supporting a pair of vertically aligned swing assemblies. In such embodiment, water may be dispensed from two water bottles simultaneously.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A water bottle swing comprising, in combination:

a water bottle having a body with cylindrical configuration and a spout formed on a top thereof, the spout having a tubular configuration with a diameter less than that of the body;

a stand including two pairs of legs with the legs of each pair having a first end coupled together thereby defining an inverted V-shaped configuration, the pairs of legs each residing in spaced vertical planes, the stand further including a support assembly including four linear braces coupled to form a square with corners that are mounted to each of the legs adjacent second ends thereof at a common elevation for maintaining the relative position of the pairs of legs;

a swing assembly including an O-ring and a pair of U-shaped members each having a pair of top ends coupled to the O-ring such that a remaining portion of the U-shaped members resides therebelow, the top ends of the U-shaped members coupled to the O-ring in order that a pair of planes in which the U-shaped members reside are perpendicular with respect to each other, one of the U-shaped members being rotatably coupled at a central extent thereof between the first ends of the legs of the stand such that the swing assembly pivots only about a horizontal axis, whereby the water bottle is situated within the swing assembly so that water may be easily dispensed therefrom; and a retainer including a tab extending upwardly and radially outwardly from one of the top ends of one of the U-shaped members, the tab having an aperture formed in an upper extent thereof, the retainer further including a loop wire having a linear portion with a first end having a plurality of threaded grooves formed therein and a second end with a circular loop portion formed thereon, the loop portion residing in a plane that forms an angle with a plane in which the linear portion resides, the linear portion of the loop wire adapted be slidably situated through the aperture of the tab so that the loop portion resides in a plane elevated from and parallel with that in which the O-ring of the swing assembly resides and is further situated about the spout of the water bottle, the retainer further including a wing nut for screwably coupling with the threaded grooves of the linear portion of the wire loop thereby precluding the removal of the wire loop from the tab and water bottle from the swing assembly during use.

2. A water bottle swing comprising:

a water bottle having a body with cylindrical configuration and a spout formed on a top thereof, the spout having a tubular configuration with a diameter less than that of the body;

a stand;

a swing assembly including an O-ring and a pair of U-shaped members each having a pair of top ends coupled to the O-ring such that a remaining portion of the U-shaped members resides therebelow, the top ends of the U-shaped members coupled to the O-ring in order that a pair of planes in which the U-shaped members reside are perpendicular with respect to each other, one of the U-shaped members being rotatably coupled with the stand, whereby the water bottle is situated within the swing assembly so that water may be easily dispensed therefrom;

a retainer for precluding the removal of the water bottle from the swing assembly during use;

wherein the retainer includes a tab extending upwardly and radially outwardly from one of the top ends of one of the U-shaped members, the tab having an aperture formed in an upper extent thereof, the retainer further including a loop wire having a linear portion with a first end having a plurality of threaded grooves formed therein and a second end with a circular loop portion formed thereon, the linear portion of the loop wire adapted be slidably situated through the aperture of the tab so that the loop portion resides in a plane elevated from and parallel with that in which the O-ring of the swing assembly resides and is further situated about the spout of the water bottle, the retainer further including a wing nut for screwably coupling with the threaded grooves of the linear portion of the wire loop thereby precluding the removal of the wire loop from the tab and water bottle from the swing assembly during use.

3. A water bottle swing as set forth in claim 2 wherein the loop wire is constructed from metal.

4. A water bottle swing as set forth in claim 2 wherein the stand includes two pairs of legs with the legs of each pair having a first end coupled together thereby defining an inverted V-shaped configuration, the pairs of legs each residing in spaced vertical planes.

5. A water bottle swing as set forth in claim 4 wherein the stand further includes a support assembly including four linear braces coupled to form a square with corners that are mounted to each of the legs adjacent second ends thereof at a common elevation for maintaining the relative position of the pairs of legs.

6. A water bottle swing for supporting a water bottle having a body and a spout formed on a top thereof, the spout having a tubular configuration with a diameter less than that of the body, the swing comprising:

a stand;

a swing assembly rotatably coupled with the stand, whereby the water bottle may be situated within the swing assembly so that water may be easily dispensed therefrom; and a rigid retainer for selectively precluding the removal of the water bottle from the swing assembly;

wherein the retainer includes a tab extending upwardly and radially outwardly from the swing assembly, the retainer further including a loop wire having a linear portion with a first end removably and fixedly coupled to an upper extent of the tab, the linear portion of the loop wire further including a second end with a loop portion formed thereon, the linear portion of the loop wire adapted to be coupled to the tab so that the loop portion resides in a plane elevated from and parallel with a plane in which a top of the swing assembly resides and is further adapted to be selectively situated about the spout of the water bottle.

* * * * *